United States Patent [19]

Hanna et al.

[11] 4,117,491

[45] Sep. 26, 1978

[54] LOGARITHMICALLY PERIODIC LOOP ANTENNA ARRAY WITH SPACED FILTERS IN THE COUPLING NETWORK

[75] Inventors: Kheder Abdul Karim Hanna; Brian Stuart Collins, both of Rochester, England

[73] Assignee: C & S Antennas Limited, Rochester, England

[21] Appl. No.: 709,625

[22] Filed: Jul. 29, 1976

[30] Foreign Application Priority Data

Aug. 20, 1975 [GB] United Kingdom ..... 34646/75

[51] Int. Cl.[2] ..... H01Q 11/10; H01Q 3/24

[52] U.S. Cl. ..... 343/742; 343/792.5; 343/854

[58] Field of Search ..... 343/742, 792.5, 854, 343/855, 722

[56] References Cited

U.S. PATENT DOCUMENTS

| | | | |
|---|---|---|---|
| 2,466,354 | 4/1949 | Bagnall | 343/854 |
| 3,626,418 | 12/1971 | Berryman | 343/742 |
| 3,721,990 | 3/1973 | Gibson et al. | 343/740 |
| 3,765,022 | 10/1973 | Tanner | 343/792.5 |
| 3,808,599 | 4/1974 | Brunner | 343/792.5 |

*Primary Examiner*—Eli Lieberman

*Attorney, Agent, or Firm*—Henry M. Bissell

[57] ABSTRACT

A logarithmic type of aerial array is formed of a plurality of similar broadband active aerial elements linearly arranged with logarithmic spacings, each aerial element being connected to a frequency-sensitive filter. The filters have progressive frequency-sensitive characteristics along the array such as to tend to pass higher frequencies where the elements are more closely spaced and lower frequencies where the elements are more widely spaced. The aerial elements are preferably each in the form of a loop, the impedance around the loop being increased in a region on the opposite side of the loop from the loop termination.

17 Claims, 8 Drawing Figures

LOGARITHMICALLY PERIODIC LOOP ANTENNA ARRAY WITH SPACED FILTERS IN THE COUPLING NETWORK

BACKGROUND OF THE INVENTION

This invention relates to aerials, particularly aerial arrays for high frequency (H.F.) applications.

Logarithmic aerial arrays of various forms are known, and one form comprises a plurality of spaced substantially linearly-arranged aerial elements, the spacing between adjacent elements along the array being in a progressive logarithmic relation. Typically the aerial elements are dipoles.

The object of this invention is to produce an aerial array of compact dimensions having improved operational characteristics.

SUMMARY OF THE INVENTION

In accordance with this invention, such an aerial array is characterised in that the aerial elements are broadband active aerial elements with substantially equal impedance, and by a plurality of filters each connected to a respective one of the aerial elements, the filters having progressive frequency-sensitive characteristics along the array such as to tend to pass higher frequencies where the elements are more closely spaced and lower frequencies where the elements are more widely spaced.

While the aerial elements can for example be simple whip aerials, preferably they are each in the form of a loop having a termination at one point on the loop, the impedance around the loop being increased relative to the rest of the loop in a region on the opposite side of the loop from the termination.

The filters are preferably fed from a single transmission line which runs along the array, but they may be fed in other ways, for example by individual transmission lines radiating from a single signal source.

The aerial array is in principle equally applicable for transmission and reception, and it is to be appreciated that references to either one situation are simply by way of example.

BRIEF DESCRIPTION OF THE DRAWINGS

The invention will now be described in more detail with reference to the accompanying drawings, in which.

DETAILED DESCRIPTION OF THE PREFERRED EMBODIMENTS

Figure 1:
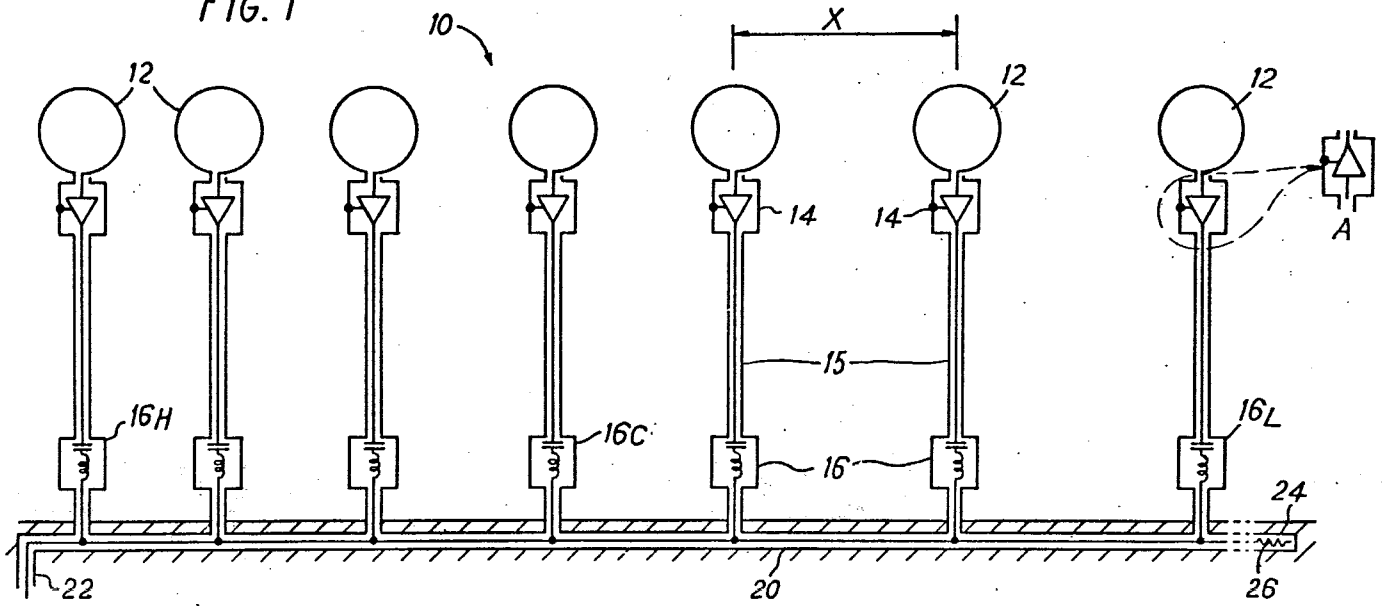
FIG. 1 illustrates somewhat diagrammatically a preferred embodiment of the invention in which the aerial elements are fed progressively from one end of the array.

Referring to FIG. 1 an aerial array 10 comprises a plurality of, in this case seven, identical loops 12.

The current which flows in a loop antenna can be represented as a Fourier series of sine and cosine terms. The zero order term represents a constant current flowing around the loop and gives rise to the familiar figure-of-eight radiation pattern typical of a small loop. The odd order or sine terms represent currents which flow in the same direction in both sides of the loop and, therefore, do not give rise to any output voltage across a balanced terminating impedance. In a small loop, the azimuth radiation pattern associated with this current mode is circular.

When the loop is fed with an unbalanced feed both even and odd modes can exist, and the total radiation pattern of the loop is the sum of those due to the individual modes. In a simple loop the zero order mode predominates. However we have appreciated that if the zero order mode current can be reduced in amplitude relative to the first order mode current, and the relative phase of the current suitably adjusted, it would be possible to obtain a cardioid radiation pattern. This result can be achieved by inserting an impedance in series in the loop at a point diametrically opposite the feedpoint, as shown in FIG. 2.

The impedance has essentially no effect on the odd order current modes as it is placed at a current node, but is effective on the zero and even order modes as it is at an antinode for these modes. The impedance is arranged to reduce the amplitude of the zero order mode such that at 180° from the desired propagation direction the zero and first order modes produce waves of approximately equal strength but 180° out of phase. It is found that in practice the impedance is required to be predominantly resistive.

Figure 2:
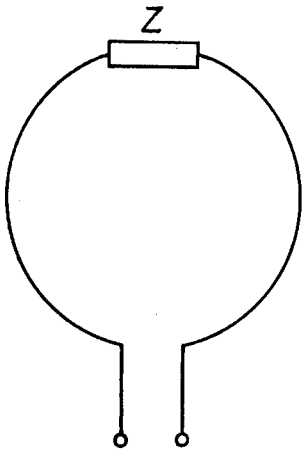
FIG. 2 illustrates a loop antenna forming one of the aerial elements.

A terminated loop of the type shown in FIG. 2 can be arranged to exhibit an approximately cardioid radiation pattern for vertically polarised incident radiation and an input impedance which may easily be matched to 50 ohms, enabling easy connection to existing amplifiers and filters.

Figure 3:
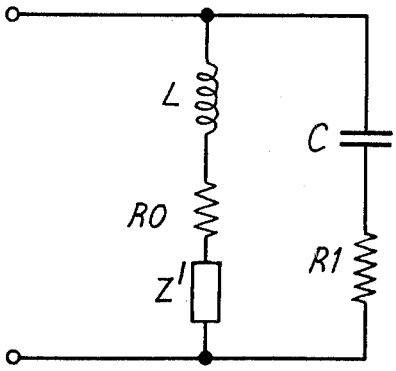
FIG. 3 shows the equivalent circuit of the loop of FIG. 2.

FIG. 3 shows an equivalent circuit for the loop. The equivalent circuit consists of two branches, a zero-order branch comprising an inductance L, a resistance RO and the added impedance $Z^1$, and a first-order branch comprising a capacitance C and a resistance R1.

Figure 4:
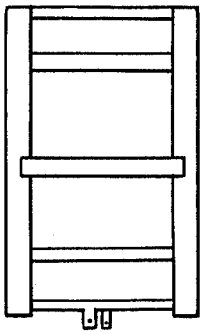
FIG. 4 is a side view of an antenna of the type illustrated in FIG. 2.
Figure 5:
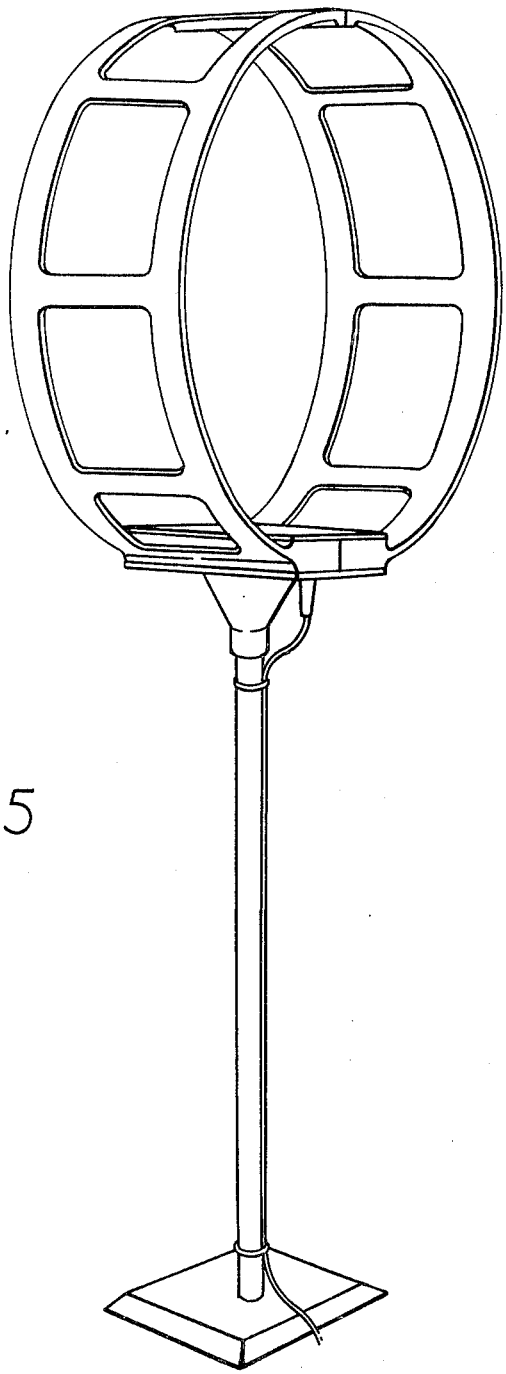
FIG. 5 is a perspective view of a practical loop antenna.

FIGS. 4 and 5 show a practical H.F. antenna of the type shown in FIG. 2. The loop is formed of two conductive strips coupled together around the loop to give a loop of large effective width. This helps to reduce the series inductance L and shunt capacitance C of the loop. The loop is broken at the top and joined by a resistor soldered to two adjacent coupling strips. The strip can be aluminium and is preferably embedded in glass fibre reinforced plastics material, so as to be light and rigid. In order to ensure that a received signal is raised to a level at which it will overcome the internal noise of the receiver, and to buffer the output of the loop, a low noise amplifier is connected to the output of the loop and is housed in a box at the base of the loop. The d.c. power supply to the amplifier can be fed along the same coaxial cable as carries the signal from the loop antenna to the receiver, a suitable filter being included at each end.

Unlike most antennas, the effective height (or area) of a loop increases as wavelength decreases. Preferably therefore the amplifier has a gain which falls with frequency. In order to avoid disturbance by MF or VHF signals the pass band of the amplifier should be restricted by filtering. The amplifier is constructed so as to ensure minimum intermodulation characteristics.

A typical size for the loop is a diameter of 0.80 m and width of 0.30 m, giving it an effective height of about 0.70 m. We have used aerials of this type over the frequency range 2 to 30 MHz and have found that added resistances Z' in the range 50 ohms to 150 ohms have been effective. Normally the optimum value for the resistor will be found empirically as it depends on a large number of factors including the geometry of the loop and in particular on the self-inductance of the loop and the end capacitance at the termination of the loop.

It will be appreciated that it is possible for the added impedance to be distributed around a portion of the loop on the opposite side of the loop from the termination, rather than being located at a single point. While resistive impedances have been described, they need not always be purely resistive.

It will also be appreciated that the loop can be used for transmission or reception, and, although only circular loops have been described, loops of other geometry such as rectangular or square could be useful in different circumstances.

Referring again to FIG. 1, it will be seen that each loop 12 has an associated wide-band amplifier 14 which, for reception, has its input connected across the two ends of the loop, and for transmission has its output connected across the ends of the loop, as indicated at detail A. Considering a receiving aerial, the output of each amplifier 14 is applied by a feeder 15 to a respective band-pass filter 16 consisting essentially of a series tuned circuit, the output of which is applied to a coaxial transmission line 20 which runs along the array 10. One end 22 of the transmission line constitutes the output of the array and the other end 24 is optionally terminated by a terminating load 26.

The spacings X between adjacent loop centres are related logarithmically in a well-known manner as in conventional log-periodic dipole aerial arrays and as described in more detail below. The frequency variation as between the various elements of the array is not caused by the elements themselves, but rather by the characteristics of the band-pass filters 16 associated with them. The loops themselves are in fact broadband aerials. The filters 16 are constructed as band-pass filters, the centre frequencies of which are also related logarithmically. The high frequency end of the array is the left-hand end as seen in FIG. 1 where the loops are more closely spaced, and the low-frequency end is the right-hand end where the loops are more widely spaced. The respective end filters $\mathbf{16}_H$ and $\mathbf{16}_L$ can be constructed as high-pass and low-pass filters if desired to extend the operating range of the aerial somewhat.

As regards the element spacings, in a conventional log dipole array, the angle which lies between the lines joining the ends of the elements ($\alpha$) is a specified design parameter. Having specified $\alpha$ and the design ratio ($\tau$) the lengths and positions of each element are defined. The gain and beamwidth of the antenna can be described as functions of $\alpha$ and $\tau$ and an optimum combination of properties can be obtained. Design curves may be found in several standard texts and details are not therefore given here. In the case of the log loop array, no physical angle $\alpha$ exists. However, by redefining $\alpha$ as:

$$\alpha = \cot^{-1}(f_n \cdot x_n/75)$$

where $f_n$ is the centre frequency of the bandpass filter connected to the $n^{th}$ loop, and $x_n$ is its distance from the apex, an analogous parameter to the conventional case results, albeit that the parameter is now a mathematical entity and not a physically measurable angle.

There are a number of other variables which need to be optimised in the design of an array, including the centre frequencies and Q factors of the band-pass filters, the output impedance of the amplifiers, and the characteristic impedance and velocity ratio of the transmission line. Suitable values for any particular H.F. application can be found by experiment. A typical range of Q factors which we have found useful is in the region of 4 to 6. Some of these parameters may even be varied with distance along the array to provide control of the aerial characteristics as a function of frequency.

The ability to determine the characteristics by choice of these parameters is one of the advantages of the array. The characteristics are in no way restricted by the characteristics of the individual aerial elements 12 and these are themselves broadband. While loop aerials are preferred, they may be replaced by whip aerials or short dipoles. Likewise the impedance relationships can be adjusted as desired through the filters 16.

If the array is extended further to the high frequency end there may be a tendency for the loops to overlap. In this case they can conveniently be staggered into two parallel closely-spaced lines.

If the design parameters of a particular array require a 180° phase shift between alternate elements, this can be achieved by including a 1:1 transformer between each pair of elements along the feeder.

The array is capable of firing (i.e. providing a directional beam) in either direction along the array, depending on how the parameters are chosen. Naturally since the loops are themselves directional aerials it is important that they face in the same direction in the array as a whole. A high back-to-front ratio is maintained compared with conventional log-periodic arrays, due to the directivity of the individual loops.

The array has a number of other advantages, in particular it has a low profile, is of simple construction, can have constant performance over a broad frequency range, and is readily accessible for maintenance from ground level. Design of the array is simplified as mutual impedances may be ignored, and the amplifiers present a constant impedance to the aerial element over a wide frequency range.

Figure 6:
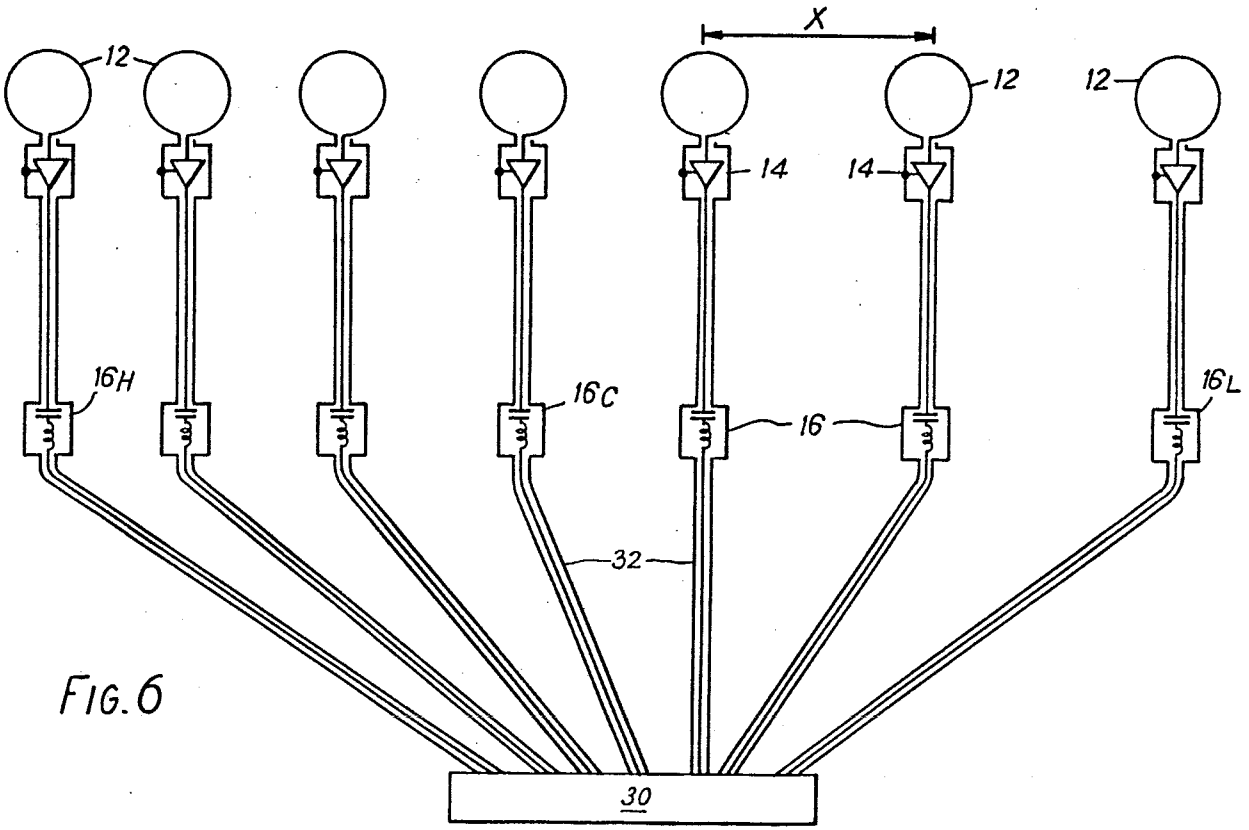
FIG. 6 illustrates an alternative aerial array.

FIG. 6 shows an alternative and less preferred array in which similar references are used to denote similar components. The array differs from the array of FIG. 1 in the method of feeding the loops. In FIG. 6 the filters 16 are connected to a receiver block 30 by individual transmission lines 32. In addition, the filters are different, and indeed the centre filter $\mathbf{16}_C$ can be an all-pass filter, i.e. can be omitted. Filters proceeding from the high frequency side of filter $\mathbf{16}_C$ are then high-pass filters with an increasingly sloping characteristic, and filters proceeding from the low frequency side of filter $\mathbf{16}_C$ are low-pass filters with an increasingly sloping characteristic. The end filters $\mathbf{16}_H$ and $\mathbf{16}_L$ are conveniently high-pass and low-pass filters respectively with relatively sharp cut-offs.

Figure 7:
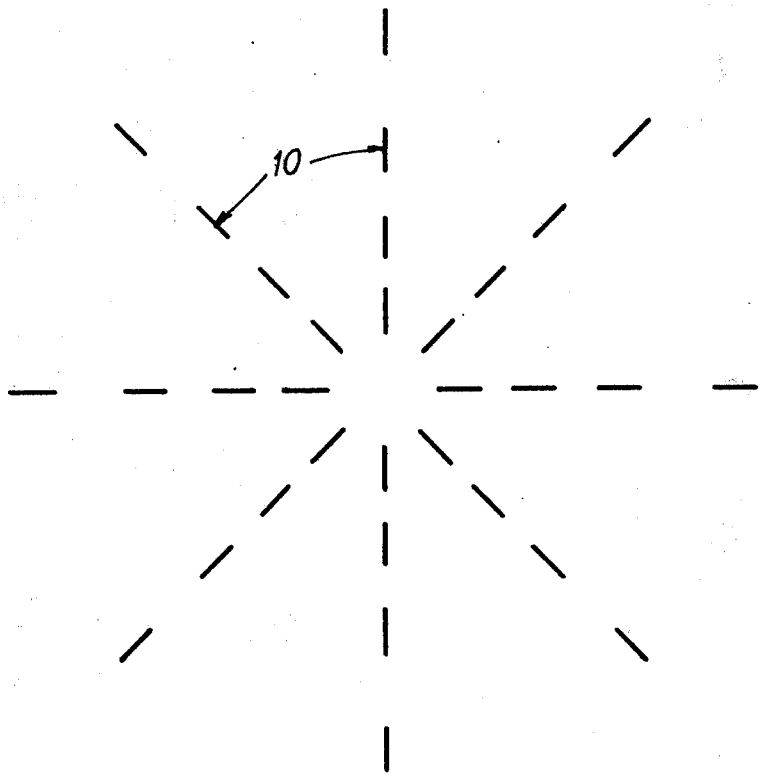
FIG. 7 is a plan view of a rosette of arrays of the type described with reference to FIG. 1.

The array 10 of FIG. 1 can be used in a rosette arrangement as shown in the plan view of FIG. 7 to enable transmission or reception in a selected direction throughout 360°. As shown, eight identical arrays 10 are used firing radially outwards. To obtain high directivity, an output beam may be formed by selective switching so as to add the outputs of two, three or four adjacent arrays. The outputs of individual lines can be used to provide a rather broader beam.

The radiation patterns of the individual arrays are affected very little indeed by firing from the high frequency end through the arrays on the other side of the rosette, if this is desired.

Figure 8:
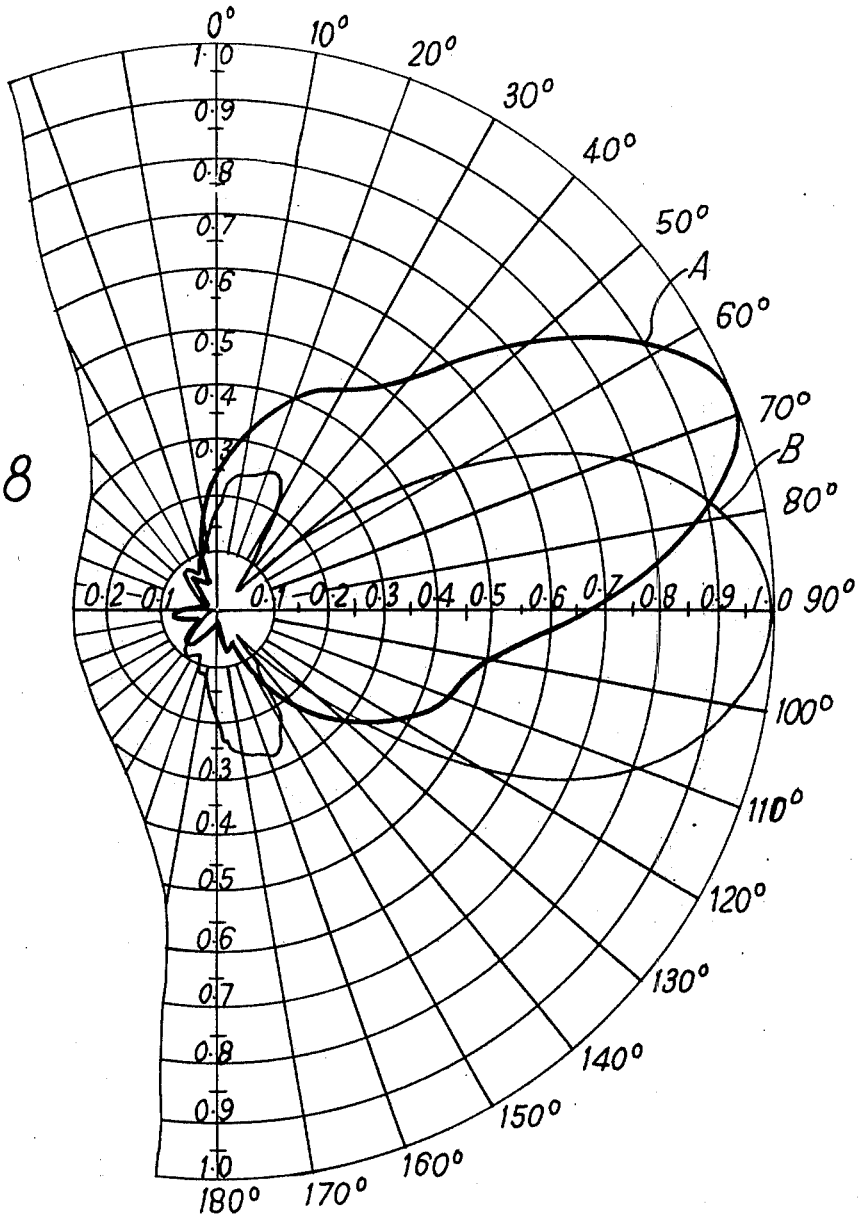
FIG. 8 shows the radiation pattern of the rosette in the horizontal plane.

A typical radiation pattern is shown in FIG. 8. Curve A shows the radiation pattern formed by two adjacent arrays being fed together, and curve B shows the radiation pattern formed by feeding three arrays. It will be seen that in this way a total of 16 directional beams can be produced.

As shown in FIG. 1 the feeders 15 are all of constant length. We have found, however, that improved operation may be obtained by progressively varying the lengths of the feeders along the array, such that the feeder 15H for the highest frequency loop is the longest and the feeder 15L for the lowest frequency loop is the shortest. The feeder lengths in this modification should be linearly related to the distance of the loop from the apex of the logarithmic array.

The arrays described have several advantages over conventional log-periodic arrays. In particular they are much cheaper to instal and maintain than a conventional dipole array due to their much smaller size, and this also means that they occupy less land and can be used near airports where low-flying aircraft are to be expected. Furthermore they are less conspicuous on the landscape. They also provide superior performance in that they have an inherently better front/back ratio, and also the directivity of the array varies little with frequency over a wide range. Finally the designer of the array has greater freedom to optimise the design parameters than in the case of a conventional array, and thus has more control over the radiation characteristics of the array.

We claim:

1. An aerial array, comprising:

feed terminal means;

a plurality of spaced substantially linearly-arranged broadband active aerial elements with substantially equal impedance, all of said elements being of substantially identical size and electrical characteristics, and the spacing between adjacent ones of said elements along said array being in a progressive logarithmic variation, and a plurality of filters each connected individually between a respective one of said aerial elements and said feed terminal means, said filters having progressive frequency-sensitive characteristics along the array such as to tend to pass between the associated element and said feed terminal means higher frequencies where said elements are more closely spaced and lower frequencies where said elements are more widely spaced.

2. An aerial array according to claim 1, including a wide-band amplifier between each aerial element and its associated filter.

3. An aerial array according to claim 1, wherein each filter comprises a series tuned circuit.

4. An aerial array according to claim 1, wherein the filters are fed from a single transmission line which runs along the array.

5. An aerial array according to claim 1, wherein the filters are fed by individual transmission lines.

6. An aerial array according to claim 5, wherein one filter is an all-pass filter.

7. An aerial array according to claim 1, wherein each filter is connected to its associated aerial element by a feeder, and wherein the lengths of the feeders are progressively increased as the element spacings progressively decrease.

8. In a rosette aerial construction comprising a plurality of substantially radially orientated aerial arrays, signal processing means, and switching means for selectively switching one or a predetermined combination of said arrays to said signal processing means, wherein the improvement consists in that each aerial array comprises:

a plurality of spaced substantially linearly-arranged broadband active aerial elements with substantially equal impedance, all of said elements of each array being of substantially identical size and electrical characteristics, and the spacing between adjacent ones of said elements along said array being in a progressive logarithmic variation, and a plurality of filters each connected individually between a respective one of said aerial elements and said switching means, said filters having progressive frequency-sensitive characteristics along the array such as to tend to pass between the associated element and the switching means higher frequencies where said elements are more closely spaced and lower frequencies where said elements are more widely spaced.

9. An aerial array, comprising:

a plurality of spaced substantially linearly-arranged, substantially parallel aerial loops having substantially equal impedance, the spacing between adjacent loops along said array being in a progressive logarithmic variation, each loop having a termination at a point on the loop which is on a line passing through the center of the loop and which is subtantially at right angles to a line joining the centers of all the loops, and the impedance around each loop being increased relative to the rest of the loop in a region on the opposite side of the loop from said termination, and a plurality of filters each connected to a respective one of said loops, said filters having progressive frequency-sensitive characteristics along said array such as to tend to pass higher frequencies where said loops are more closely spaced and lower frequencies where said loops are more widely spaced.

10. An aerial array according to claim 9, wherein one terminal of each loop and one terminal of the associated filter are grounded.

11. An aerial array according to claim 9 including a wide-band amplifier between each loop and its associated filter.

12. An aerial array according to claim 9, wherein each filter comprises a series tuned circuit.

13. An aerial array according to claim 9, wherein the filters are fed from a single transmission line which runs along the array.

14. An aerial array according to claim 9, wherein the filters are fed by individual transmission lines.

15. An aerial array according to claim 14, wherein one filter is an all-pass filter.

16. An aerial array according to claim 9, wherein each filter is connected to its associated loop by a feeder, and wherein the lengths of the feeders are progressively increased as the loop spacings progressively decrease.

17. An aerial array accordingto claim 9, wherein the impedance is increased by a resistor inserted in the loop.

* * * * *